US005246149A

United States Patent [19]

Broitzman

[11] Patent Number: 5,246,149

[45] Date of Patent: Sep. 21, 1993

[54] PITCHER WITH AN ASYMMETRICAL ICE DAM

[76] Inventor: Stephen K. Broitzman, P.O. Box 5992, Snowmass Village, Colo. 81615

[21] Appl. No.: 920,243

[22] Filed: Jul. 27, 1992

[51] Int. Cl.[5] ..... A47G 19/14

[52] U.S. Cl. ..... 222/465.1; 222/572; 222/575

[58] Field of Search ..... 222/465.1, 475.1, 566, 222/572, 575

[56] References Cited

U.S. PATENT DOCUMENTS

| | | | |
|---|---|---|---|
| D. 252,846 | 7/1979 | Miller . | |
| 1,145,422 | 7/1915 | Jones | 222/465.1 |
| 2,006,704 | 7/1935 | van Muffling | 222/572 X |
| 3,809,290 | 10/1972 | Schmit | 222/88 |
| 4,403,709 | 5/1980 | Meins et al. | 220/90.4 |
| 4,492,323 | 11/1985 | Essen | 222/465 R |
| 4,655,373 | 7/1984 | Essen | 222/465.1 |
| 4,957,224 | 9/1989 | Kessler | 220/465.1 |

FOREIGN PATENT DOCUMENTS

| | | | |
|---|---|---|---|
| 803645 | 7/1936 | France | 222/572 |
| 695608 | 8/1953 | United Kingdom | 222/572 |

*Primary Examiner*—Andres Kashnikow
*Assistant Examiner*—J. A. Kaufman
*Attorney, Agent, or Firm*—Rick Martin

[57] ABSTRACT

An ice tea pitcher has an asymmetrical ice dam having a major and minor lip disposed about the pouring spout. All the ice is dammed by the major lip when the server pours the tea. Should the server desire to add a few cubes of ice into the tea while pouring, he merely adjusts the position of the major lip to allow a few ice cubes to float on by.

6 Claims, 5 Drawing Sheets

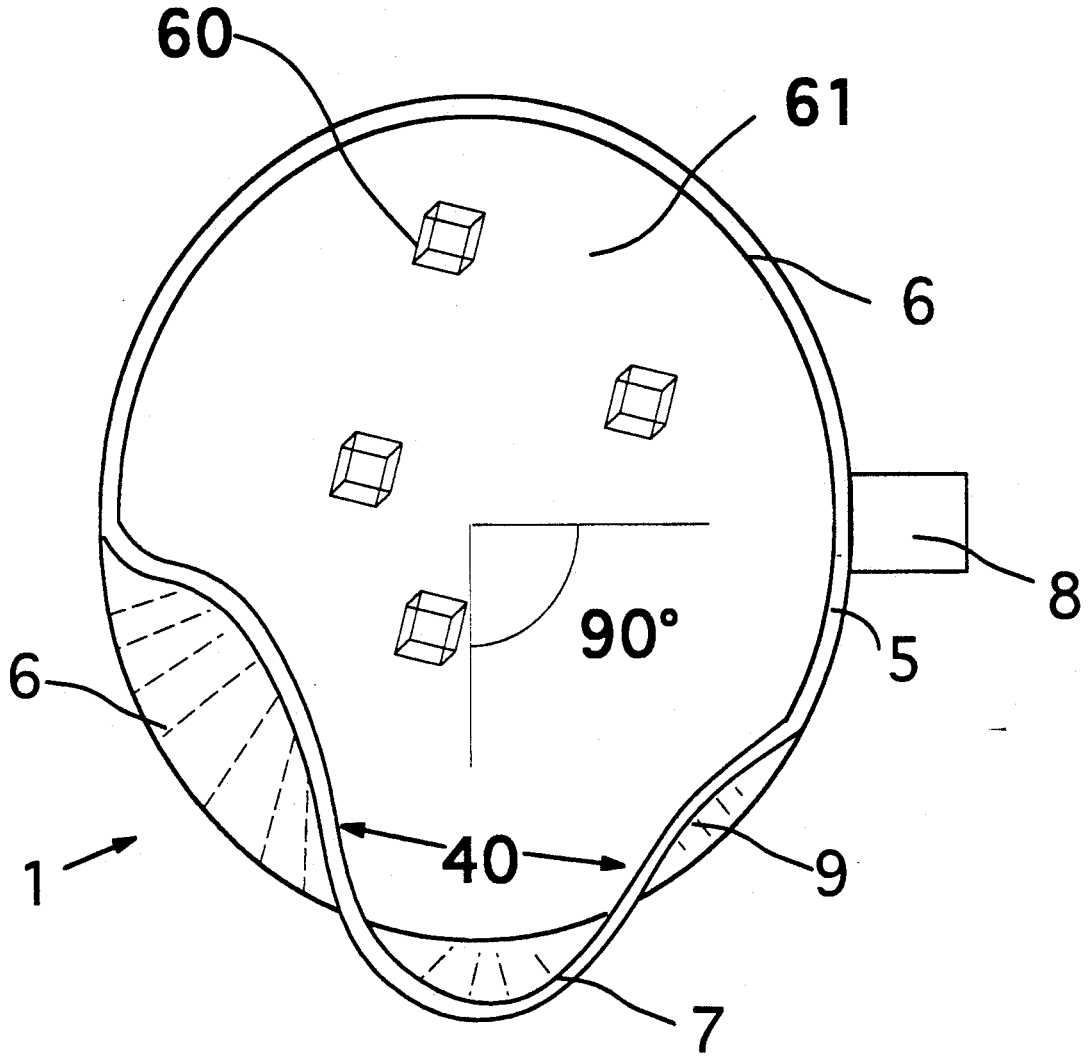
FIGURE
3

PITCHER WITH AN ASYMMETRICAL ICE DAM

FIELD OF THE INVENTION

The present invention relates to serving pitchers designed to pour liquid and ice simultaneously.

BACKGROUND OF THE INVENTION

Potable liquids are commonly served from a pitcher. When iced liquid is desired, a problem of restricting all or some delivery of the ice exists.

Some past attempts have been made to provide pitchers covered by lids having selective openings that give a choice between free flowing delivery of both ice and liquid or ice-free delivery of liquid. However, covers and lids are less sanitary than open-top pitchers. See U.S. Pat. No. 4,403,709 (1980) to Wolfgang Meins et al. This invention discloses a liquidcontaining container provided with a lid for creating a can opening.

See U.S. Pat. No. 4,655,373 (1984) to Eric Essen. This invention discloses a pitcher for pouring water. A lid is hinged at the top of the container portion allowing pivoting of the lid between an open position and a closed position. A spout is located at the hinge. Open-top pitchers with an ice guard incorporated having a projecting pouring spout and an auxiliary spout for iced liquid delivery has already been suggested. However, if iced liquid is desired, the server must deliver it from the side spout of the pitcher. This type of service results in a generally nondirectional and uncontrollable flow of iced liquid and/ or spillage.

See U.S. Pat. No. 4,957,224 (1989) to William Kessler. This invention discloses a multi-spouted serving open-top pitcher including an angled spill guard. The pitcher also includes at least one auxiliary spout defined in the spill guard.

See also U.S. Pat. No. 3,809,290 (1972) to Justin M. Schmit. This invention discloses a dispensing device consisting of a flexible sealed liquid-containing pouch mounted within the confines of a rigid wall container having a pouring spout characterized by a bayonet-ended tubular element constructed and arranged to perforate a portion of the side wall of the pouch. This is secured to and extends across the open end of a tubular member disposed within the confines of the pouch. The invention facilitates the dispensation of its contents. The pouch is capable of being readily removed and replaced with a similar pouch.

See also U.S. Pat. No. 4,492,323 (1985) to Eric Essen. This invention discloses a pitcher for pouring water or other liquid having a container portion. A lid is hinged at the top of the container. A spout is located at the hinge. None of the prior art teaches an asymmetrical ice dam which allows the server to more precisely control the flow of ice.

The present invention provides a solution for sanitary serving of liquid with controllable dispensing of ice-free and iced liquid. The pitcher according to this invention facilitates the controllable flow of a liquid and an ice simply and efficiently and minimizes the spillage. This pitcher is also easy to clean, to store and to fill with liquid and ice.

Other features and advantages of the present invention will become readily apparent from the following detailed description of the invention.

SUMMARY OF THE INVENTION

The main object of the present invention is to provide an ice dam that allows a controllable flow of ice from a container.

Another object of the present invention is to provide an ice dam that allows blockage of all the ice in the container while still enabling a controllable flow of liquid.

Other objects of this invention will appear from the following description and appended claims, reference being had to the accompanying drawings forming a part of this specification wherein like reference characters designate corresponding parts in the several views.

BRIEF DESCRIPTION OF THE DRAWINGS

FIG. 3 is a top plan view of the pitcher

FIG. 4(*b*) is a top perspective view as in 4(a) showing the pitcher rotated counterclockwise thereby restricting all the ice from flowing and allowing only liquid to flow.

DETAILED DESCRIPTION OF THE PREFERRED EMBODIMENT

Figure 1:
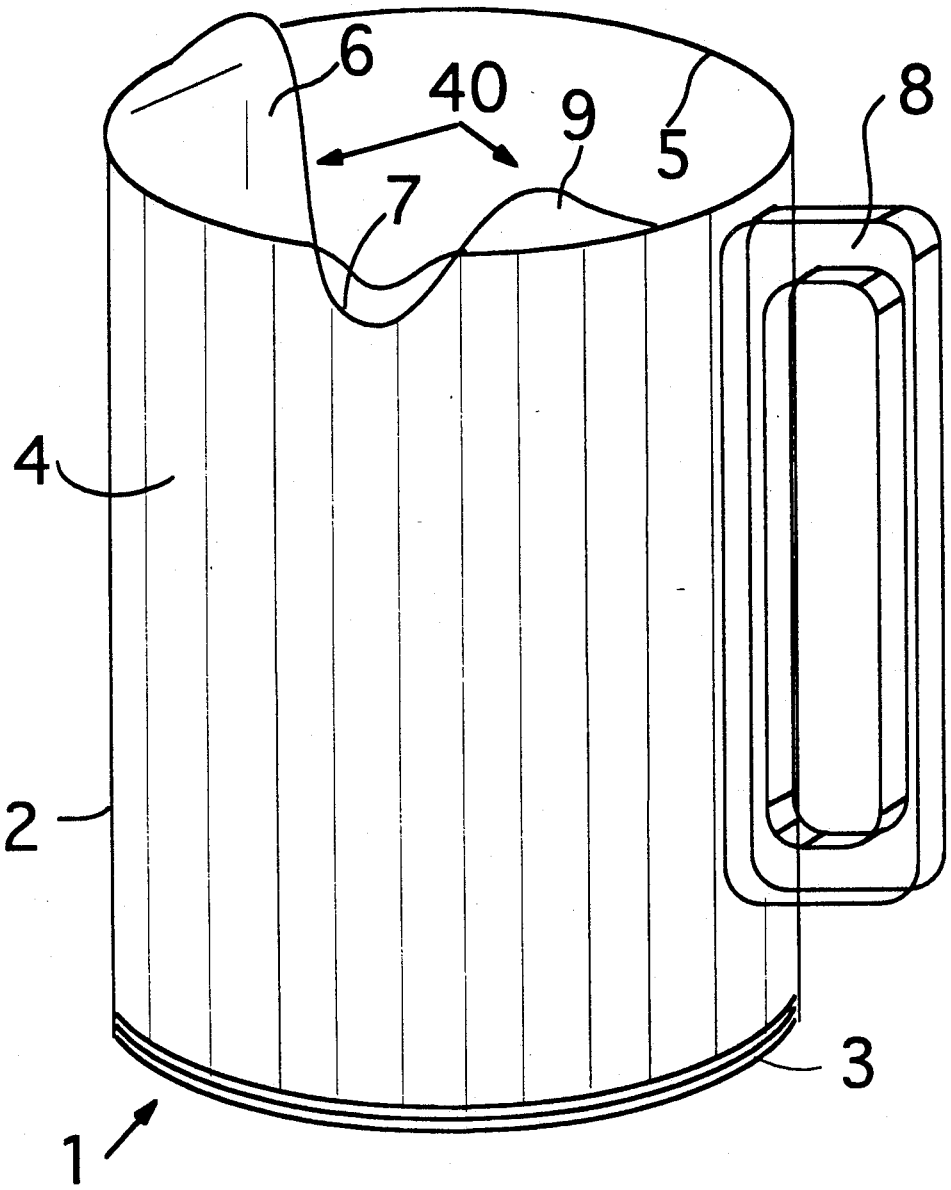
FIG. 1 is a front perspective view of the pitcher.

While this invention is susceptible of embodiment in many different forms, there is shown in the drawings one specific preferred embodiment which will be described in detail. It is understood, however, that the present disclosure is intended to exemplify principles of the invention and is not intended to limit the invention to the embodiment illustrated.

Referring to FIG. 1 a front perspective view is shown of a asymmetrical side pouring pitcher 1 of this invention illustrated with all its preferred features. The pitcher 1 comprises a container 2. The container 2 may be generally cylindrical. Container 2 has a substantially flat support base 3 and a substantially vertical wall 4 with an open upper edge 5.

Figure 2:
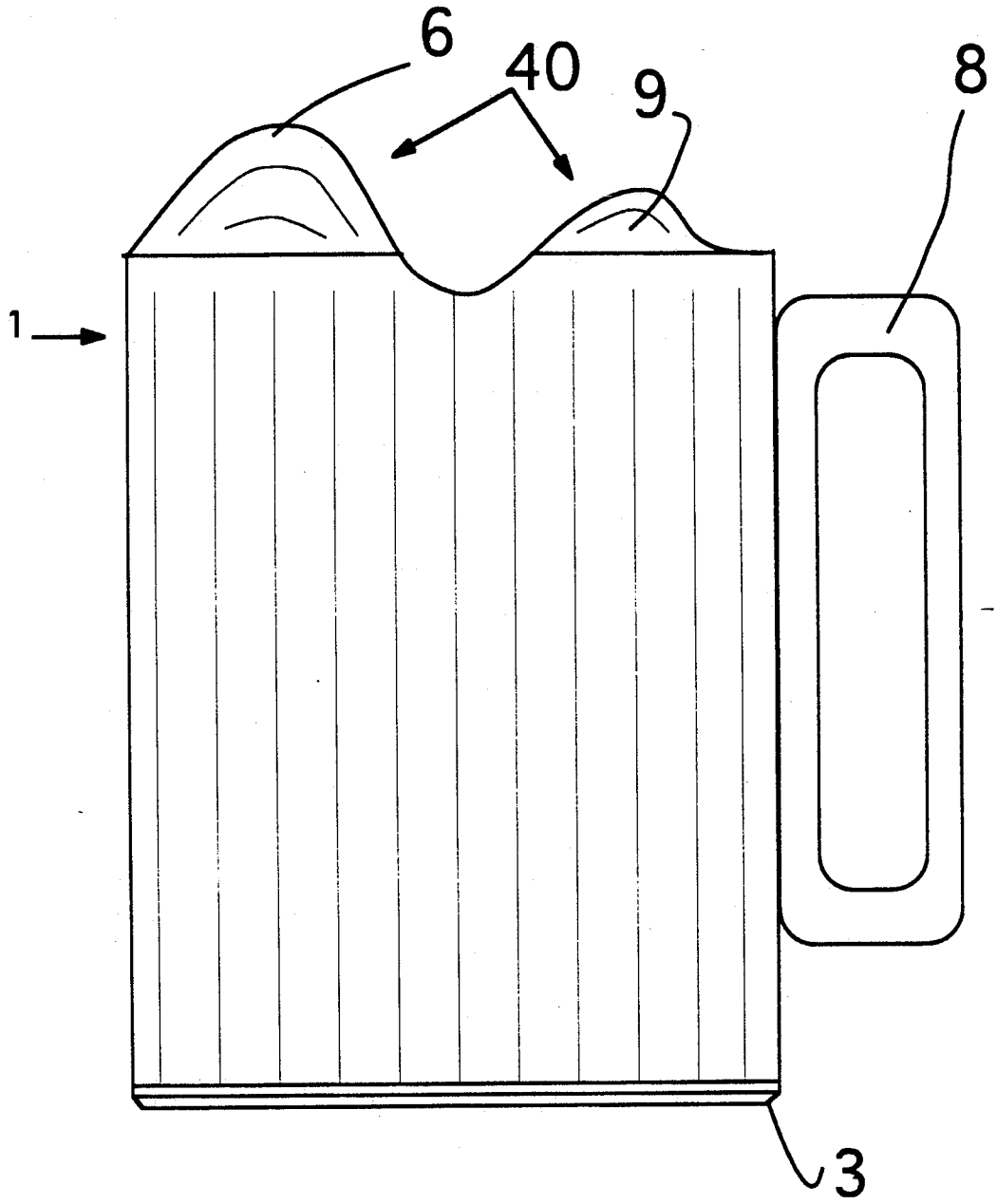
FIG. 2 is a front plan view of the pitcher.

As illustrated in FIGS. 1,2 and 3, two portions of the upper edge 5 of the wall 4 are extended inwardly from the wall 4 and are generally angled upwardly from the plane of the upper edge 5 to form an ice dam 40 for retention of delivery of ice floating in the liquid. However, the shape and angle of the ice dam 6 is not limited and can be varied. Preferably, the ice dam 40 is shaped for restricting the delivery of floating ice. Ice dam 40 further comprises major lip 6 and minor lip 9.

Figure 4A:
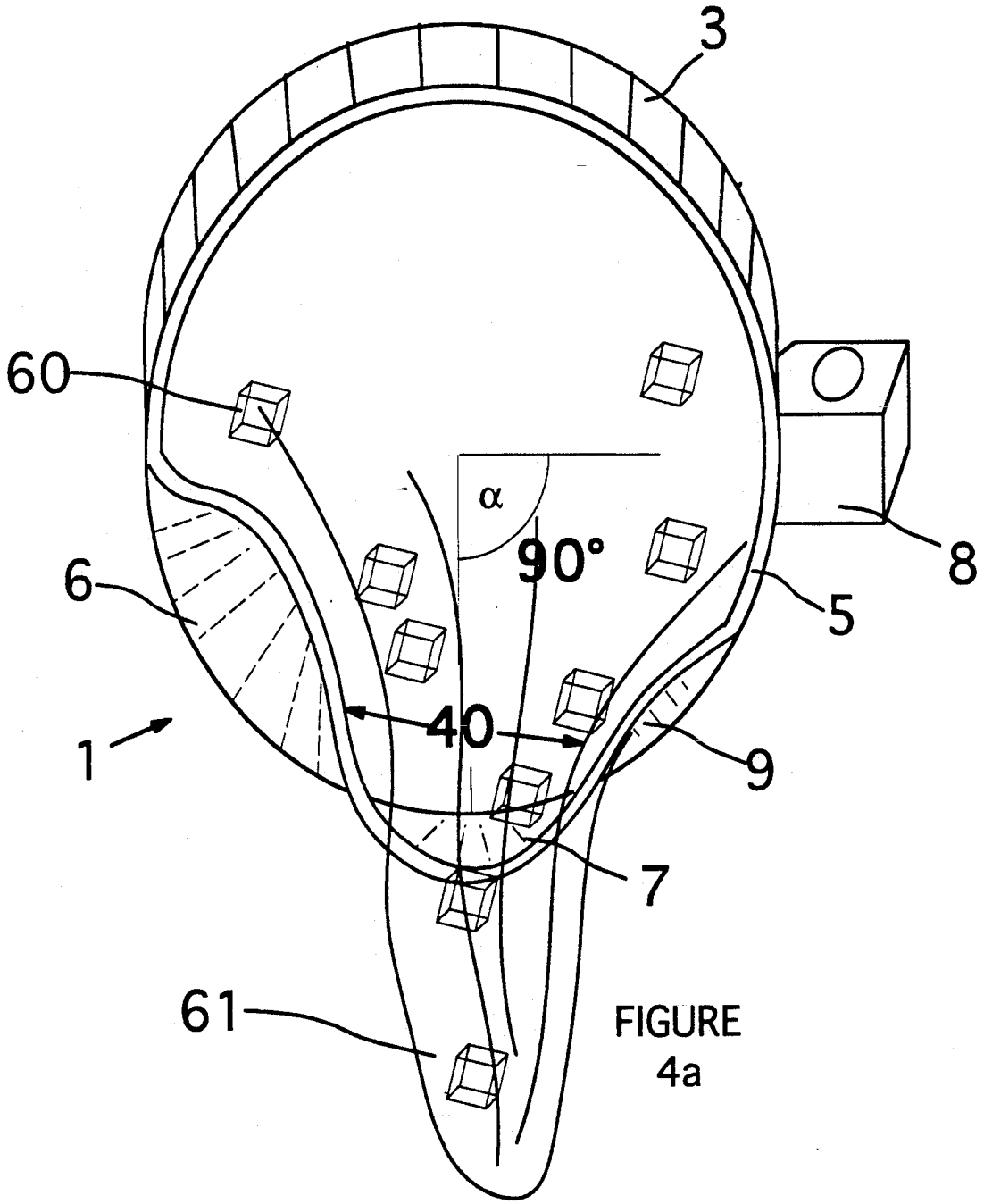
FIG. 4(*a*) is a top perspective view of the pitcher in operation allowing a controlled flow of both liquid and ice.
Figure 4B:
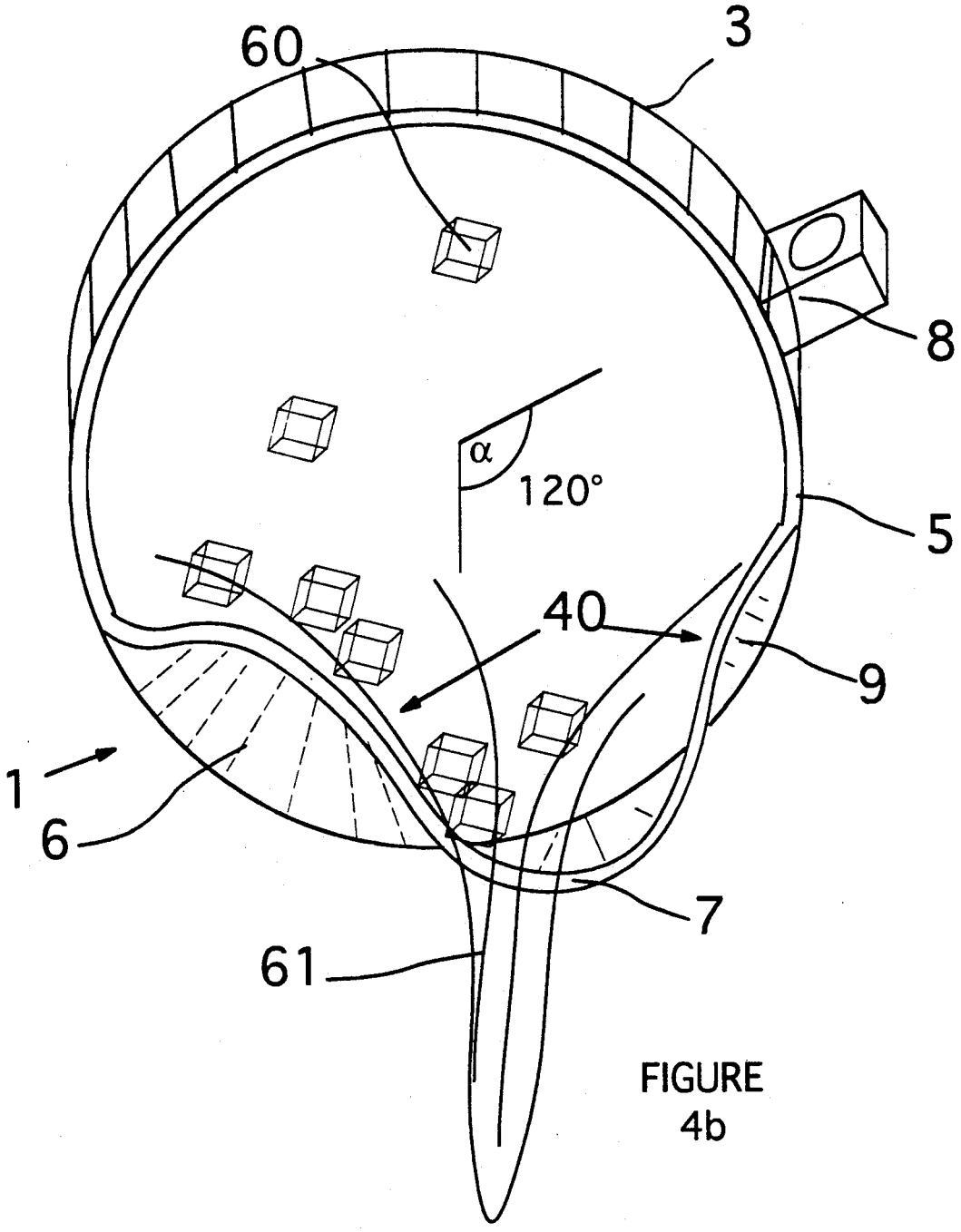

Refer to FIGS. 4(*a*) and 4(*b*). In operation a server (not shown) can grab handle 8 and rotate the pitcher 1 raising the base 3 thereby pouring fluid from the pitcher 1 through the spout 7. Next the server may wish to precisely control the amount of ice pouring out of the pitcher 1. FIG. 4(*a*) shows a verticle axis y and a 90 degree angle between y and the handle 8. In operation this position allows both liquid 61 and ice 60 to flow thru spout 7. The asymmetrical ice dam 40 comprised of major lip 6 and minor lip 9 is in a position where major lip 6 partially blocks ice 60, thus allowing the server to slightly vary the angle alpha by rotating his wrist. Varying the angle alpha allows the server to rather precisely control how much ice 60 floats over major lip 6 mixing with liquid 61 and flowing down spout 7. Thus this invention differs from all the prior art by allowing the ice 60 to be blocked by a single major lip 6 rather than to be blocked by a traditionally symmetrical pair of lips( not shown) on either side of spout 7.

In FIG. 4(*b*) the server has increased angle alpha to about 120 degrees, thereby allowing major lip 6 to block all the ice 60. Only liquid 61 can flow though spout 7. The asymmetrical ice dam 40 prevents ice 60 to butt against one another on either side of spout 7 as is traditional in the prior art. Thus, spillage and uncontrollable bursts of ice 60 are prevented. The server can thus pour a glass of iced tea with exactly six pieces of ice 60 in a glass if he so desires.

Referring now to FIG. 1,2 and 3 we see that the handle is set at a 90 degree angle to spout 7. This allows a server to more easily control the position of major lip 6 relative to the flow of liquid 61. A 180 degree relationship between handle 8 and spout 7 is also possible as is a pair of asymmetrical ice dams 40 (all not shown as they are merely design choices). Handle 8 could be replaced by suitable indentations on the container (not shown).

Another embodiment (not shown) would eliminate altogether minor lip 9 and/or spout 7. This embodiment would allow the moderate control of ice but would not allow a very good control of the flowing liquid.

Particularly suitable materials for constructing a pitcher of this invention are nontoxic to human, relatively rigid and easily sanitized. Such materials preferably comply with the regulation of the Food Additives Amendment of 1958 in the Federal Food Drug and Cosmetic Act as suitable for use with potable food products. Exemplary materials that are sanitizable include glass, synthetic resin plastic, aluminum, stainless steel and the like.

Particularly preferred is moldable plastic material, such as polypropylene, polyethylene, polyvinyl chloride, polyethylene terephthalate (PET), acrylic plastic and the like.

A pitcher of this invention can be constructed by generally known manufacturing operations, such as blow molding, injection molding, casting extrusion, drawing and the like. Blow molding is particularly preferred. Polypropylene is particularly preferred for blow molding a pitcher of this invention.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A container adaptable for retention and delivery of a liquid containing ice, the container comprising:

a substantially planar base;

at least one wall;

an ice dam means for resisting pouring of said ice;

said at least one wall terminating in an upper edge parallel to said planar base, and said wall cooperating with said base to form a unitary liquid-retentive well; said well being substantially symmetrically disposed about an axial plane passing perpendicularly through said base; and said ice dam means comprising a semi-circular skirt depending inwardly over said well from said upper edge and terminating in an inner edge; said inner edge presenting a major lip and a minor lip with a space in between, thereby forming an asymmetrical ice dam through which said liquid can flow when said container is substantially horizontal, and said ice can be controllably retained by rotating said container to move said major lip in front of the flowing ice.

2. The container of claim 1 wherein said upper edge further comprises a circle.

3. The container of claim 1 wherein said ice dam means further comprises said skirt arcing upwardly from said base.

4. The container of claim 1 wherein said wall comprises a handle located substantially between 90° and 180° from said space between said major and minor lips.

5. The container of claim 1 wherein said upper edge further comprises a spout projecting outwards from said axial plane from said space between said major and minor lips.

6. A container adaptable for retention and delivery of a liquid containing ice, the container comprising:

a substantially planar base;

at least one wall;

an ice dam means for resisting pouring of said ice;

said at least one wall terminating in a circular upper edge parallel to said base and cooperating with said base to form a unitary liquid-retentive well, said well being substantially symmetrically disposed about an axial plane passing perpendicularly through said base;

said ice dam means comprising a semi-circular skirt depending inwardly and upwardly over said well from said upper edge and terminating in an inner edge presenting an asymmetrical ice dam having a major lip and a minor lip with a space in between;

a spout projecting outwards from said upper edge from said space between said major and minor lips; and said wall further comprising a handle located substantially between 90° and 180° from said space, whereby rotating said handle when said container is substantially horizontal causes said major lip to retain said ice in a controllable manner ranging from no ice to a moderate amount of ice to a rush of ice.

* * * * *